US005664703A

United States Patent [19]

Reifenberger et al.

[11] Patent Number: 5,664,703

[45] Date of Patent: Sep. 9, 1997

[54] PUMP DEVICE WITH COLLAPSIBLE PUMP CHAMBER HAVING SUPPLY CONTAINER VENTING SYSTEM AND INTEGRAL SHIPPING SEAL

[75] Inventors: John E. Reifenberger, Cincinnati; Robert J. Peterson, Loveland; Robert E. Stahley, Middletown, all of Ohio; J. Randall Stigall, Hebron, Ky.; Michael D. Webb, West Chester, Ohio; Geneva G. Otten, Loveland, Ohio; William Joseph Schmitz, Cincinnati, Ohio

[73] Assignee: The Procter & Gamble Company, Cincinnati, Ohio

[21] Appl. No.: 441,173

[22] Filed: May 15, 1995

Related U.S. Application Data

[63] Continuation-in-part of Ser. No. 203,321, Feb. 28, 1994, abandoned.

[51] Int. Cl.[6] ..... B65D 37/00

[52] U.S. Cl. ..... 222/207; 222/321.7

[58] Field of Search ..... 222/207, 212, 222/213, 384, 383.1, 321.7, 382, 153.06, 153.13

[56] References Cited

U.S. PATENT DOCUMENTS

| | | | |
|---|---|---|---|
| 2,774,518 | 12/1956 | Greene | 222/209 |
| 2,824,672 | 2/1958 | Wersching | 222/207 |
| 3,124,275 | 3/1964 | Lake | 222/182 |
| 3,193,154 | 7/1965 | Bross | 222/207 |
| 3,471,092 | 10/1969 | Hickey | 239/579 |
| 3,752,366 | 8/1973 | Lawrence et al. | 222/207 |
| 3,910,444 | 10/1975 | Foster | 215/295 |
| 3,973,700 | 8/1976 | Schmidt et al. | 222/153 |
| 4,082,223 | 4/1978 | Nozawa | 239/333 |
| 4,101,057 | 7/1978 | Lo Maglio | 222/207 |

(List continued on next page.)

FOREIGN PATENT DOCUMENTS

| | | | |
|---|---|---|---|
| 394750 | 10/1990 | European Pat. Off. | 222/207 |
| WO 92/22495 | 6/1991 | European Pat. Off. | B67D 5/42 |
| 0520315 | 12/1992 | European Pat. Off. | B05B 11/00 |
| WO 93/14983 | 1/1993 | European Pat. Off. | B65D 23/10 |
| WO 94/13547 | 12/1993 | European Pat. Off. | B65D 41/18 |
| 1442883 | 5/1966 | France . | |
| 2305-365 | 3/1975 | France | B65D 47/26 |
| 2380-077 | 9/1978 | France . | |
| 2524348 | 10/1983 | France . | |
| 2621-557-A | 10/1987 | France | B65D 01/32 |
| 2630-712-A | 4/1988 | France | B65D 47/34 |
| 3817632 | 11/1989 | Germany | 222/207 |
| 3909633 | 10/1990 | Germany . | |

*Primary Examiner*—Philippe Derakshani
*Attorney, Agent, or Firm*—Ronald W. Kock

[57] ABSTRACT

A liquid dispensing pump is provided with a supply container venting system and a shipping seal. The pump device includes an upper and lower housing which are axially movable relative to each other between open and closed shipping seal positions. The dispensing pump includes a collapsible pump chamber with at least one shipping seal functional element integral with the chamber. The pump includes actuation elements which cooperate to prevent pump actuation when the shipping seal is closed. The pump may also include a tamper evident device to prevent pump actuation prior to tamper evident tab removal. The chamber may also include an integral valve which has the valve member biased against the valve seat. A supply container venting system for the pump comprises a resilient annular flange angled downward from the bellows at the liquid entry end. The annular flange presses against an interior surface of the lower housing to seal a supply container vent opening against communication with ambient air and moisture. The annular flange remains in contact with the interior surface until either a vacuum generated in the supply container by pumping fluid therefrom deflects the flange away from the interior surface or at least one lug on the upper housing contacts and deflects the annular flange when the upper housing is actuated downward. A wiper extends from the lower housing in contact with the telescopingly engaged upper housing to further minimize any moisture entry between housings that could accumulate and inadvertently pass into the supply container.

19 Claims, 16 Drawing Sheets

U.S. PATENT DOCUMENTS

| | | | |
|---|---|---|---|
| 4,120,429 | 10/1978 | Vignot | 222/207 |
| 4,147,282 | 4/1979 | Levy | 222/387 |
| 4,204,614 | 5/1980 | Reeve | 222/153 |
| 4,220,264 | 9/1980 | Gamadia | 222/207 |
| 4,232,828 | 11/1980 | Shelly, Jr. | 239/329 |
| 4,260,079 | 4/1981 | Cary et al. | 222/209 |
| 4,273,290 | 6/1981 | Quinn | 239/493 |
| 4,310,104 | 1/1982 | Takatsuki | 222/131 |
| 4,313,568 | 2/1982 | Shay | 239/333 |
| 4,318,498 | 3/1982 | Magers et al. | 222/153 |
| 4,336,895 | 6/1982 | Aleff | 222/207 |
| 4,358,057 | 11/1982 | Burke | 239/333 |
| 4,589,574 | 5/1986 | Foster | 222/153 |
| 4,624,413 | 11/1986 | Corsette | 239/333 |
| 4,640,444 | 2/1987 | Bundschuh | 222/321 |
| 4,651,904 | 3/1987 | Schuckmann | 222/383 |
| 4,655,690 | 4/1987 | Boedecker et al. | 417/53 |
| 4,732,549 | 3/1988 | von Schuckmann | 222/207 |
| 4,781,311 | 11/1988 | Dunning et al. | 222/153 |
| 4,846,372 | 7/1989 | von Schukmann | 222/136 |
| 4,858,478 | 8/1989 | Kush et al. | 73/864.35 |
| 4,858,788 | 8/1989 | Meckenstock | 222/207 |
| 4,863,070 | 9/1989 | Andris | 222/211 |
| 4,898,307 | 2/1990 | Tiramani | 222/207 |
| 4,915,601 | 4/1990 | von Schuckmann | 417/472 |
| 4,979,646 | 12/1990 | Andris | 222/136 |
| 5,014,881 | 5/1991 | Andris | 222/207 |
| 5,018,894 | 5/1991 | Goncalves | 401/202 |
| 5,031,802 | 7/1991 | Joulia | 222/205 |
| 5,042,694 | 8/1991 | Birmelin | 222/145 |
| 5,096,094 | 3/1992 | Guilbert | 222/153 |
| 5,114,052 | 5/1992 | Tiramani et al. | 222/207 |
| 5,158,233 | 10/1992 | Foster et al. | 239/333 |
| 5,190,190 | 3/1993 | Fudalla | 222/105 |
| 5,195,878 | 3/1993 | Sahiavo et al. | 417/393 |
| 5,197,866 | 3/1993 | Kim | 417/472 |
| 5,205,441 | 4/1993 | Andris | 222/207 |
| 5,234,166 | 8/1993 | Foster | 239/333 |
| 5,303,850 | 4/1994 | Connan | 222/153 |
| 5,303,867 | 4/1994 | Peterson | 239/333 |
| 5,333,761 | 8/1994 | Davis et al. | 222/212 |

PUMP DEVICE WITH COLLAPSIBLE PUMP CHAMBER HAVING SUPPLY CONTAINER VENTING SYSTEM AND INTEGRAL SHIPPING SEAL

CROSS-REFERENCE TO RELATED APPLICATION

This is a continuation-in-part of prior application Ser. No. 08/203,321 entitled PUMP DEVICE WITH COLLAPSIBLE PUMP CHAMBER HAVING INTEGRAL SHIPPING SEAL, filed on Feb. 28, 1994, now abandoned.

BACKGROUND OF THE INVENTION

1. Field of the Invention

This invention relates to liquid dispensing pump devices for use with liquid consumer product containers; more particularly, to such liquid dispensing pump devices which utilize a collapsible pump chamber (e.g., a bellows).

2. Description of the Prior Art

Known liquid dispensing pump devices for use with consumer product containers are many and varied. Such dispensing pumps may be utilized to deliver liquids as a foam, a spray, or a liquid stream (e.g., as with moisturizing lotions), for example. Most commonly, such liquid dispensing pump devices utilize a piston and cylinder pump chamber. Such pump chambers require that a liquid tight moving seal be maintained between the piston and the cylinder. Disadvantages are commonly associated with this liquid tight seal requirement. For example, a relatively large amount of friction is generated as the piston moves against the cylinder, since these parts must fit tightly to form the seal. Additionally or alternatively, the parts themselves must be manufactured within tight tolerances such that the parts fit correctly to form the seal. Moreover, the wear caused by the friction can deteriorate this seal over time, reducing the efficiency of the pump. Furthermore, these piston and cylinder dispensing devices have generally been designed without significant effort to reduce the number of parts and overall cost.

In addition to piston and cylinder-type pumps, several liquid dispensing pump devices have been developed which utilize pump chambers with collapsible walls which overcome some of the disadvantages of piston and cylinder pump chambers. For example, balloon type pump chambers have been utilized. More commonly, flexible, resilient bellows have been utilized as collapsible pump chambers in liquid dispensing pump devices. Such bellows-type pumps permit the pump chamber to expand and contract in volume without the disadvantages associated with the moving seal required in piston and cylinder pumps. Furthermore, the bellows can replace the piston, the cylinder and the spring; thereby reducing molding and assembly costs. These prior liquid dispensing pump devices, however, do not offer all of the advantages of the invention described herein.

SUMMARY OF THE INVENTION

In accordance with one aspect of the present invention, a manually operated dispensing pump device is provided for pumping a liquid product from a supply container through a discharge orifice. The pump device includes a housing for sealingly mounting the dispensing pump device onto the supply container. The housing includes a portion of a liquid passage providing fluid communication from the supply container downstream to the discharge orifice. An inlet valve is located within the liquid passage which is closed to prevent liquid flow therethrough during periods of positive downstream pressure and is open during periods of negative downstream pressure. An outlet valve is located within the liquid passage which is open to permit liquid flow therethrough during periods of positive upstream pressure and is closed during periods of negative upstream pressure. A shipping, seal including two functional elements which cooperate when in a closed position to seal the liquid passage and cooperate when in an open position to permit liquid flow through the liquid passage is also provided. A collapsible pump chamber defining a portion of the liquid passage downstream of the inlet valve and upstream of the outlet valve, the collapsible pump chamber including one of the functional elements of the shipping seal as an integral component thereof.

Preferably, the manually operated dispensing pump device includes a locking feature operatively associated with the housing which prevents actuation of the pump device when the shipping seal is in the closed position and which permits actuation of the pump device when the shipping seal is in the open position. Furthermore, the manually operated dispensing pump device preferably includes a removable tamper evident tab operatively associated with the upper housing or the lower housing which prevents actuation of the pump device prior to removal of the tamper evident tab.

In accordance with another aspect of the present invention, A collapsible pump chamber for use in a manually operated dispensing pump is provided. The collapsible pump chamber includes a valve as an integral component thereof. The valve includes a valve member, a valve seat and a valve opening which are all integral components of a wall of the collapsible pump chamber, the valve-seat facing one side of the wall and the valve member being formed at an angle away from the other side of the wall so that upon pushing the valve member through the valve opening the valve member is biased against the valve seat.

BRIEF DESCRIPTION OF THE DRAWINGS

While the specification concludes with claims which particularly point out and distinctly claim the invention, it believed the present invention will be better understood from the following description of preferred embodiment taken in conjunction with the accompanying drawings, in which like reference numeral identify identical elements and wherein;

DETAILED DESCRIPTION OF THE INVENTION

Figure 1:
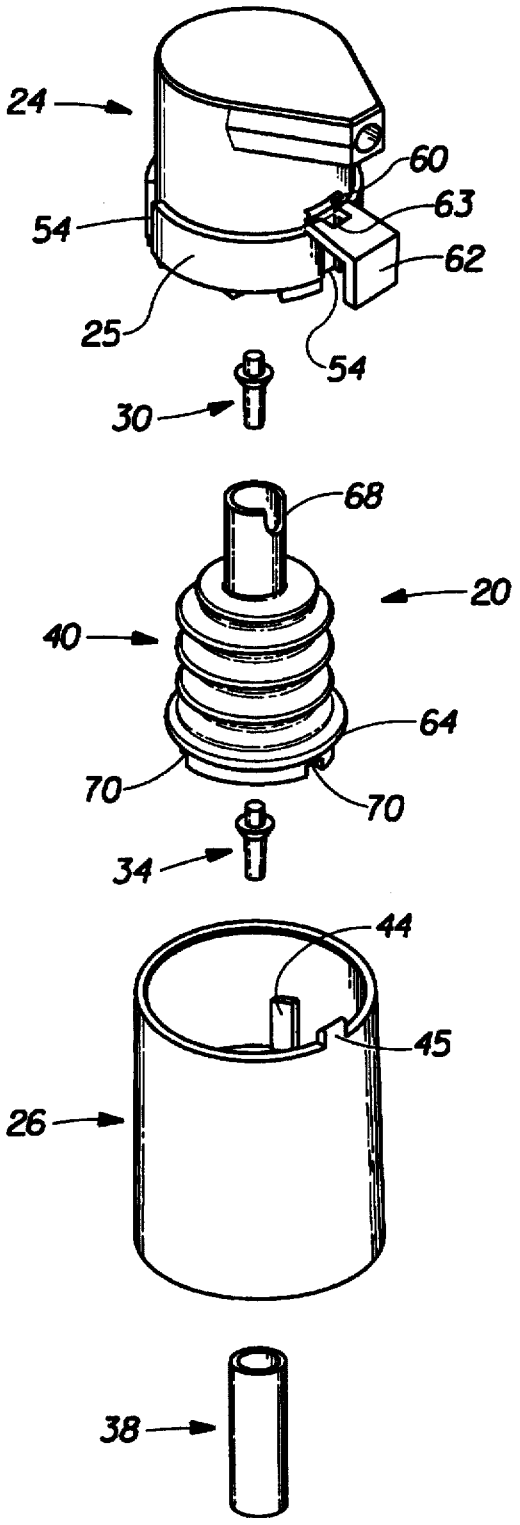
FIG. 1 is a expanded perspective view from above of a particularly preferred embodiment of the liquid dispensing pump of the present invention.

In a particularly preferred embodiment shown in FIG. 1, the present invention provides a liquid dispensing pump device, indicated generally as 20. This dispensing pump device 20 is particularly useful in conjunction with a liquid product supply container 22 (seen partially in FIG. 3). The illustrated liquid dispensing pump 20 basically includes an upper housing 24, a lower housing 26, an outlet valve member 30, and inlet vent member 34, a diptube 38, and a collapsible pump chamber 40.

As used herein, the phrase "collapsible pump chamber" is defined as a pump chamber delineated—at least partially—by a flexible wall which moves in response to a manual compressive force in such a way that the volume within the pump chamber is reduced without sliding friction between any components delineating the pump chamber. Such collapsible pump chambers may include balloon-like diaphragms and bladders made from elastomeric materials such as thermoplastic elastomers, elastomeric thermosets (including rubber), or the like. For example (not seen), the collapsible pump chamber may include a helical metal or plastic spring surrounding (or covered by) an elastic material; creating an enclosed pump chamber. However, the illustrated and preferred collapsible pump chamber is a bellows 40; i.e., a generally cylindrical, hollow structure with accordion-type walls. Bellows are preferred, for example, because they can be made resilient to act like a spring; eliminating the need for a spring. Furthermore, the collapsible pump chamber includes a functional element of a shipping seal as an integral component thereof, as described hereinafter. As used herein, the term "integral" is defined as molded, or otherwise formed, as a single unitary part.

Figure 3:
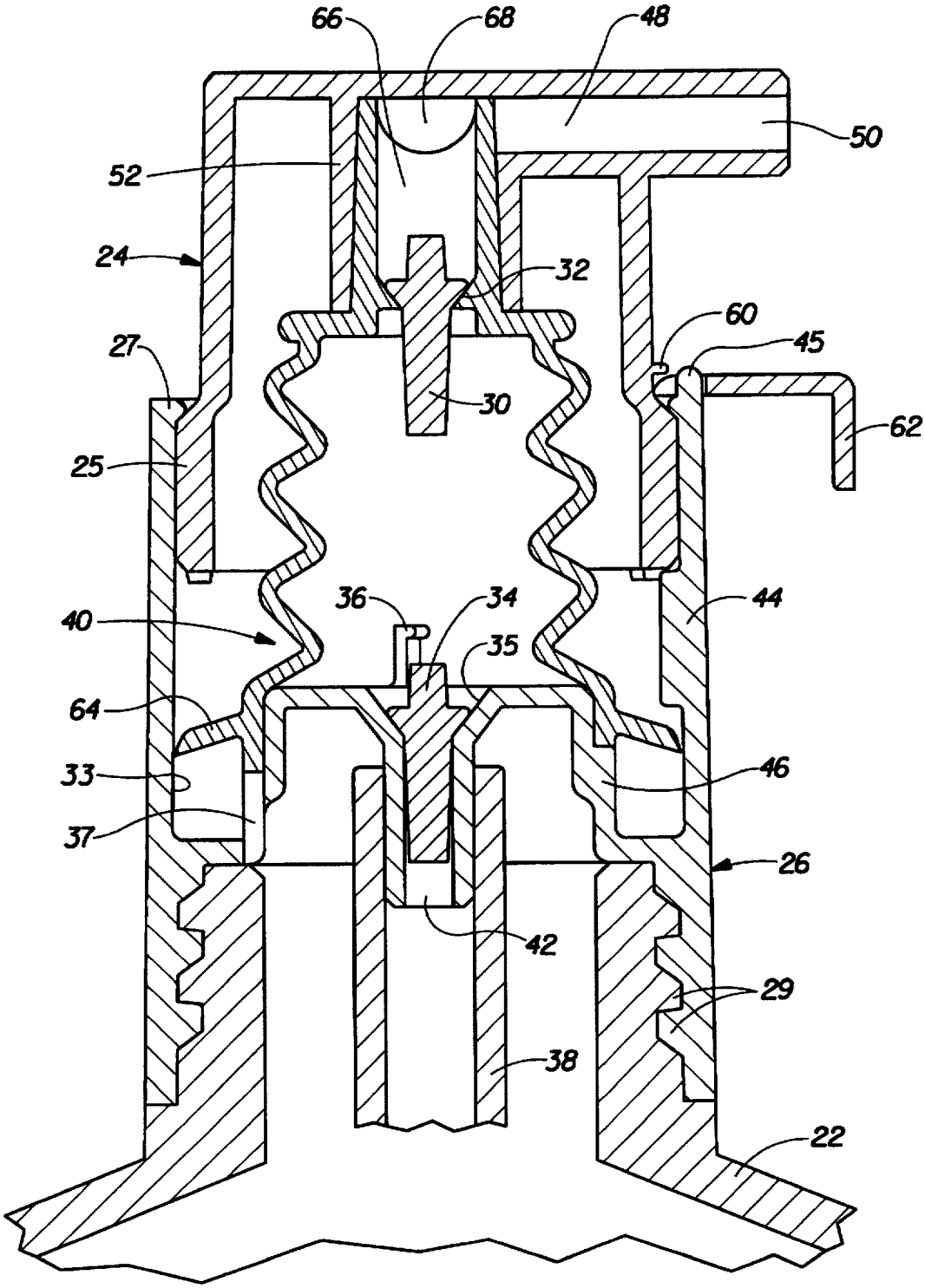
FIG. 3 is a cross,sectional view taken along the center line with the tamper evident tab intact and shipping seal closed.

Referring to FIG. 3, the upper housing 24 is telescoped onto the lower housing 26 and retained by cooperation between an annular collar 25 and an annular rib 27 The lower housing 26 includes screw threads, 29 which operate to sealingly attach the pump device 20 to the container 22. Alternatively, the lower housing 26 may utilize a bayonet-type attachment structure (not seen) such as that described, for example, in U.S. Pat. No. 4,781,311 issued to Dunning et al. on Nov. 1, 1988; or U.S. Pat. No. 3,910,444 issued to Foster on Oct. 7, 1975.

Additionally, the lower housing 26 includes an inlet passage 42 with an inner conical inlet valve seat 35 which cooperates with the inlet valve member 34 to form the inlet valve 34 and 35. Furthermore, the lower housing 26 includes three equally spaced retaining tabs 36 which retain the inlet valve member 34 during operation of the pump device 20, as discussed hereinafter. Alternatively, a ball valve (not seen) could be utilized. The lower housing 26 also includes a vent opening 37, three equally spaced actuation lugs 44, a cooperating lug 45, and three equally spaced anti-rotation lugs 46. Friction fit onto the inlet passage 42 of the lower housing 26 is a diptube 38 which extends down into the container 22.

Figure 2:
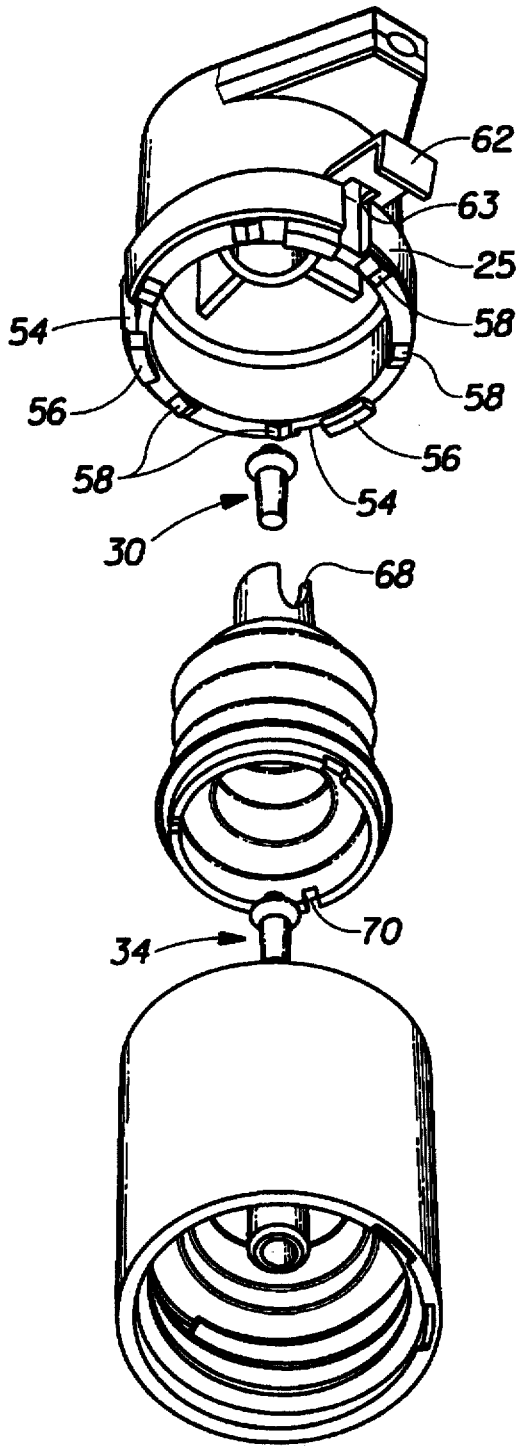
FIG. 2 is a expanded perspective view from below of the liquid dispensing pump of FIG. 1.

The upper housing 24 includes an outlet passage 48; terminating in a dispensing opening 50. An inner cylindrical wall 52 is located within the upper housing 24 at an angle to, and connected with the outlet passage 48. Additionally, (as seen, in FIG. 2) the upper housing 24 includes a collar 25 with three equally spaced actuation channels 54, three stops 56, three pairs of tactile lugs 58, a projection 60, and a removable tamper evident tab 62. As used herein, the phrase "tamper evident" is defined as providing evidence that the pump has been previously actuated; not necessarily that the product has not been tampered with (since the entire pump device may be unscrewed and replaced). Tamper evidence, in this sense is important because it discourages sampling of the product on the store shelf. Moreover, the housing 24 and 26 could include any tamper evident feature (not seen) known in the art to indicate that there has been removal of the pump device 20 from the container 22.

Passing through the housing 24 and 26 is a liquid passage which is delineated by several pans, including the diptube 38, the inlet passage 42 of the lower housing 26, the outlet passage 48 of the upper housing 24, and the collapsible pump chamber 40. The liquid passage provides fluid communication from the distal end of the dip tube 38 within the supply container 22 in a downstream direction to the discharge orifice. As used herein, the term "downstream" is defined as in the direction from the supply container 22 to the discharge orifice 50; and "upstream" is defined as in the direction from the discharge orifice 50 to the supply container 22. Similarly, as used herein, the phrase "inlet end" means the upstream end; and the phrase "outlet end" means the downstream end.

A portion of the liquid passage is defined by the collapsible pump chamber 40. The collapsible pump chamber 40 has a structure which is flexible such that it can be manually compressed; thereby reducing the volume within the collapsible pump chamber 40. Although a spring (not seen) may be utilized to help return the collapsible pump chamber 40 to its original shape, the collapsible pump chamber 40 is preferably sufficiently resilient that it returns to its initial shape when the manual compression force is released.

The illustrated collapsible pump chamber is a bellows 40. A preferred bellows 40 should have several qualities. For example, the bellows 40 should make the pump device easy to actuate. Generally this means having a spring force from about three pounds to about five pounds. The bellows 40 should also have good resiliency with minimal hysterisis and creep. Furthermore, the bellows 40 preferably has good stiffness in the radial direction (hoop strength) to ensure the bellows 40 is not radially deformed under normal operating conditions. Lastly, the bellows 40 preferably has a good volumetric efficiency; i.e., change in internal volume divided by the total expanded internal volume.

Some geometric features which can be utilized to endow the bellows 40 with the appropriate qualities include the diameter of the bellows 40. The larger the diameter the lower the spring force and the lower the radial stiffness. Although lower spring force is generally desirable, lower radial stiffness can be a problem; e.g., the bellows 40 might blow out in a precompression trigger sprayers. Increasing the wall thickness of the pleats will increase radial stiffness but it increases the spring force and results in decreased volumetric efficiency of the bellows. Reducing the pleat angle generally decreases the spring force but decreases the volumetric efficiency. The pleat angle is the aggregate of two angles; the angle above a line normal to the axis and passing through the origin of a pleat and the angle below that line. Preferably, the pleat angle above the normal line is about 30° and the pleat angle below the normal line is about 45° (making removal of the bellows from the core pin easier). Increasing the number of pleats will lower the spring force and lower the volumetric efficiency.

Although not wishing to be bound, it is believed that the major components of the spring force are the wall thickness and the upper and lower pleat angles while the major component of resiliency is material selection.

Material selection can also help endow the bellows 40 with the appropriate qualities. In general the material preferably has a Young's modulus below 10,000 psi. For lotion pumps the a Young's modulus below 3,000 psi is preferred. The material should enable retention of mechanical properties, be dimensionally stable and be resistant to stress cracking. These properties should be present over time in air and in the presence of the liquid product. Thus, for trigger sprayers which generally spray acidic or alkaline cleaning products comprised of significant quantities of water the material should not be pH sensitive and should not undergo hydrolysis. Exemplary such materials include polyolefins such as polypropylene, low density polyethylene, very low density polyethylene, ethylene vinyl acetate. Other materials which may be utilized include thermosets (e,g., rubber), and thermoplastic elastomers. Most preferred for trigger sprayers is a high molecular weight ethylene vinyl acetate with a vinyl acetate content between about 10 and 20 percent. For other pumps (e.g., lotion pumps) pH and hydrolysis may not be an issue. Instead a low spring force with a high resiliency may be more important. In such cases a low modulus ethylene vinyl acetate or a very low density polyethylene are preferred.

An exemplary bellows 40 made of ethylene vinyl acetate or very low density polyethylene might have a 0.6 in inner large diameter and a 0.4 inch inner small diameter and a wall thickness of between about 0.02 inch and 0.03 inch. The aggregate pleat angle would be about 75°; with the upper pleat angle 30° and the lower pleat angle 45°.

The inlet end of the manually compressible pump chamber 40 is attached by friction fit to the generally cylindrical inner wall of the lower housing 26. When attached, three equally spaced notches 70 on the inlet end of the bellows 40 cooperate with the three anti-rotation lugs 46 on the lower housing 26. The collapsible pump chamber 40 includes an integral annularly extending flange 64 near its inlet end. This flange 64 seals again, an interior surface 33 of the lower housing 26; to form a vent 37 and 54. Thus, the vent valve 26 and 54 includes the flange 64 which operates as a valve member and the housing 26 which provides the valve seal.

Similarly, the outlet end of the collapsible pump chamber 40 is attached by friction fit to the inner cylindrical wall 52 of the upper housing 24. The outlet end of the collapsible pump chamber 40 includes an elongate channel 66 which has an integral outlet valve seat 32 which cooperates with the outlet valve member 30 to form the outlet valve 30 and 32. The elongate channel 66 also includes an integral outlet opening 68.

The inlet valve member 34 and 35 and an outlet valve member 30 and 32 are located within the liquid passage. These valves may be of any type known in the art, including duckbill, ball, poppet or the like. Preferably the outlet valve member 30 is a lightweight ball or poppet valve member which provides suckback, as discussed hereinafter.

As seen in FIG. 3, the liquid dispensing pump 20 is in the closed position. In this position the outlet opening 68 of the bellows 40 is misaligned with the outlet passage 48; providing a fluid tight shipping seal. The shipping seal includes several functional elements; e.g., the outlet opening 68 and the cylindrical wall 52 which can be moved relative thereto to seal the outlet opening 68. Therefore, the liquid passage which flows through the diptube 38, inlet passage 42 of the lower housing 26, the bellows 40, and the outlet passage 48 of the upper housing 24 is sealed closed; thereby providing a shipping seal.

Additionally, the actuation lugs 44 are misaligned with the actuation channels 54 which prevents actuation of the pump device 20 when the shipping seal is closed. Without this feature, a increase in the pressure within the collapsible pump chamber 40 which might damage the collapsible pump chamber 40 could be caused by attempted actuation of the pump device 20 while the shipping seal is closed. In the closed position, one side of the upper end of each actuation lug 44 is located against one end of each stop 56. The other side of each actuation lug 44 is located against one of the tactile lugs 58.

Furthermore, the tamper evident tab 62 extends generally horizontally from the upper housing 24 over the top end of the lower housing 26. The illustrated tamper evident tab 62 includes a slot 63 which cooperates with a locking lug 45 to prevent rotation of the upper housing 24 relative to the lower housing 26. Thus, the shipping seal cannot be opened without removal of the tamper evident tab 62. Furthermore, the pump device 20 cannot be actuated without removing the tamper evident tab 62.

Figure 4:
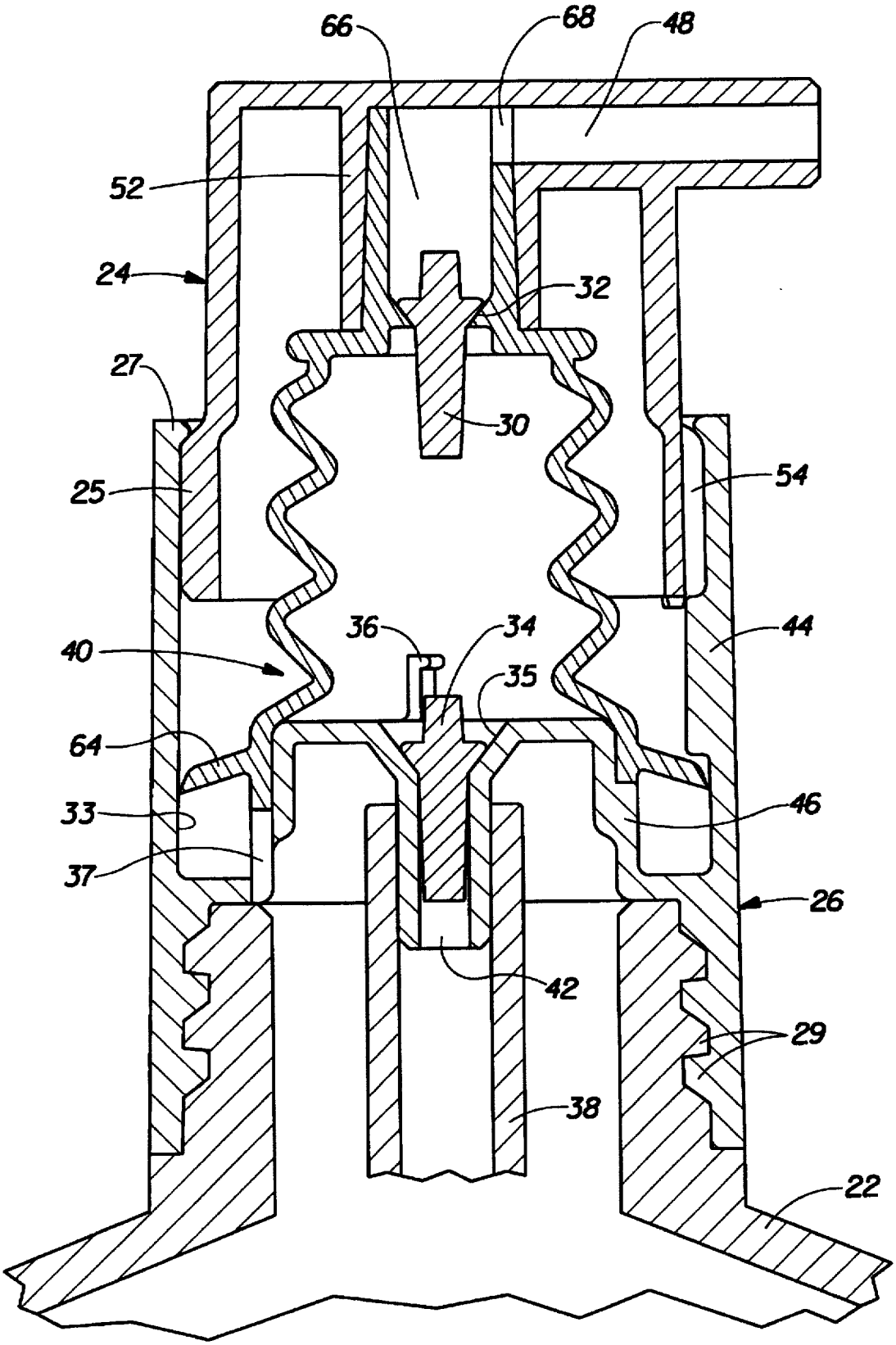
FIG. 4 is a cross sectional view, similar to FIG. 3 with the tamper evident tab removed and the shipping seal open.

As seen in FIG. 4, the liquid dispensing pump 20 is in the open position. The upper housing 24 may be rotated relative to the lower housing 26 from the closed position to the open position once the tamper evident tab 62 has been removed. The tamper evident tab 62 is removed by simply rotating it upwardly. This rotation causes the projection 60 to interfere with the tamper evident tab 62; creating a force which pushes the tab 62 away from the upper housing 24. This force causes the tab 62 to tear away from the upper housing 24 along the thinned line connecting the tab 62 to the upper housing 24. Thus, continued rotation of the tab 62 causes the tamper evident tab 62 to break off of if the tab 62 is rotated to a point where the locking slot 63 and the locking lug 45 release, due to this force. Consequently, the shipping seal cannot be opened until the tamper evident tab 62 is broken off. Needless to say this prevents on shelf sampling of the liquid product through actuation of the pump device 20 without leaving evidence of such sampling.

As the upper housing 24 is rotated, each actuation lug 44 moves from a position against one stop 56 to a position 90° away against the adjacent stop 56. During rotation, each actuation lug 44 moves against the tactile lugs 58 which provide a tactile and/or audible signal that the shipping seal of the dispensing pump device 20 is being moved—first, from the closed position and—second, into the open position. The tactile lugs 58 also help maintain the pump device 20 in the open or closed position through interaction with the actuation lugs 44.

Referring to FIG. 4, in the open position the actuation lugs 44 align with the actuation channels 54. Furthermore, the integral dispensing opening 68 aligns with the outlet passage 48; thereby opening the liquid passage. As the upper housing 24 is rotated relative to the lower housing 26, the upper housing 24 is also rotated relative to the bellows 40. The bellows 40 remains stationary relative to the lower housing 26 due in part to the cooperation between notches 70 on the inlet end of the bellows 40 and the anti-rotation lugs 46 of the lower housing 26. In contrast, the elongate channel 66 of the bellows 40 rotates within the inner cylindrical wall 52 of the upper housing 24 until the outlet opening 68 aligns with the outlet passage 48.

Figure 5:
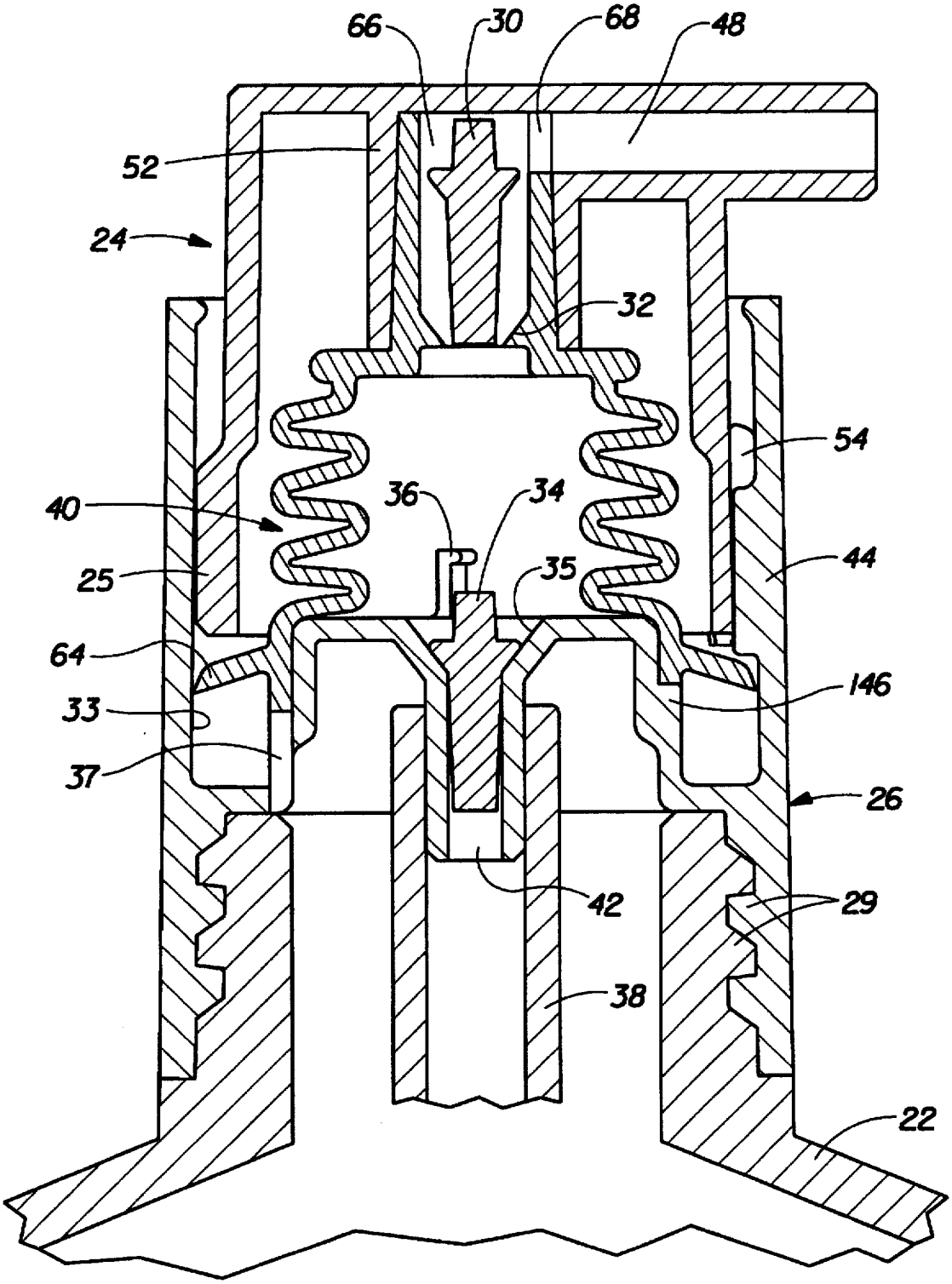
FIG. 5 is a cross sectional view, similar to FIG. 3, of the pump of FIG. 1 in operation, during the downstroke.

Referring to FIG. 5, once the pump device is in the open position it is ready for manual actuation. Manual actuation of the pump device accomplished by axially reciprocating the upper housing 24 relative to the lower housing 26. As this reciprocating action is accomplished the actuation lugs 44 slide within the actuation channels 54. During the downstroke of this reciprocating action, the inlet valve member 34 is sealed against the inlet valve seat 35. This causes pressure to increase within the collapsible pump chamber 40 which causes the outlet valve member 30 to move away from the outlet valve seat 32; thereby opening the outlet valve 30 and 32. Consequently, the liquid within the decreasing volume of the collapsible pump chamber 40 is dispensed through the integral outlet opening 68 and the outlet passage 48. As the liquid is dispensed it provides an upward force on the outlet valve member 30 which can move the outlet valve member 30 to the distal end of the integral elongate channel 66.

Upon release of the manually compressive force, the bellows 40 begins to expand, due to its resiliency. A spring (not seen) may alternatively be added to replace or supplement the resiliency of the bellows 40. This expansion creates a negative pressure (i.e., below atmospheric) within the collapsible pump chamber 40. Consequently, atmospheric pressure pushes liquid in the outlet passage 48 back into the bellows 40 (at least relatively viscous liquids) until the outlet valve member 30 again seals against the outlet valve seat 32; thereby closing the outlet valve 30 and 32. Of course, the longer the integral elongated channel 66, the more time it takes for the valve member 30 to seat, and the more liquid is sucked back into the bellows 40. Such suck back is desirable since it helps keep the dispensing passage clear between operations.

Figure 6:
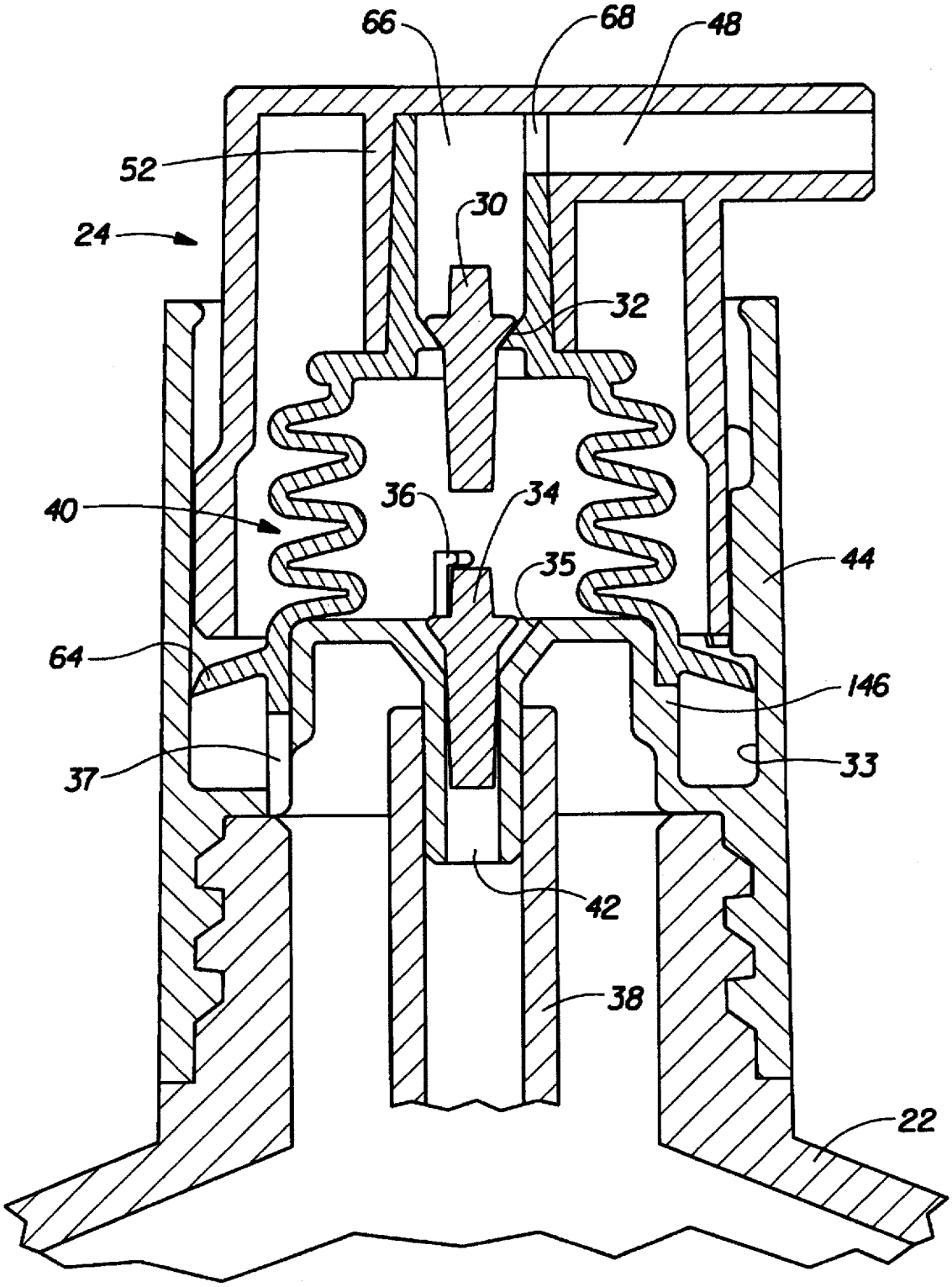
FIG. 6 is a cross sectional-view, similar to FIG. 3, of the pump of FIG. 1 in operation, during the misstroke.

Referring to FIG. 6, once the outlet valve 30 and 32 closes the negative pressure within the bellows 40 created as the bellows 40 continues to expand, causes the inlet valve member 34 to move away from the inlet valve seat 35; thereby opening the inlet valve 34 and 35. The inlet valve member 34 is retained from moving too far from the inlet valve seat 35 by the three retaining lugs 36. Thus, liquid from within the container 22 is pulled into the bellows 40 via the diptube 38 and past the inlet valve 34 and 35. Simultaneously, air is able to enter the container 22 to replace the volume of liquid exiting the container 22 by passing around the cup seal of the annular flange vent valve member 64 and the vent valve seat 26 and into the container 22 through the vent opening 37. Alternatively, as shown in FIGS. 5 and 6, tactile lugs 58 of upper housing 24 may contact annular flange 64 at the end of a full downward stroke of upper housing 24 and initiate venting.

Figure 7:
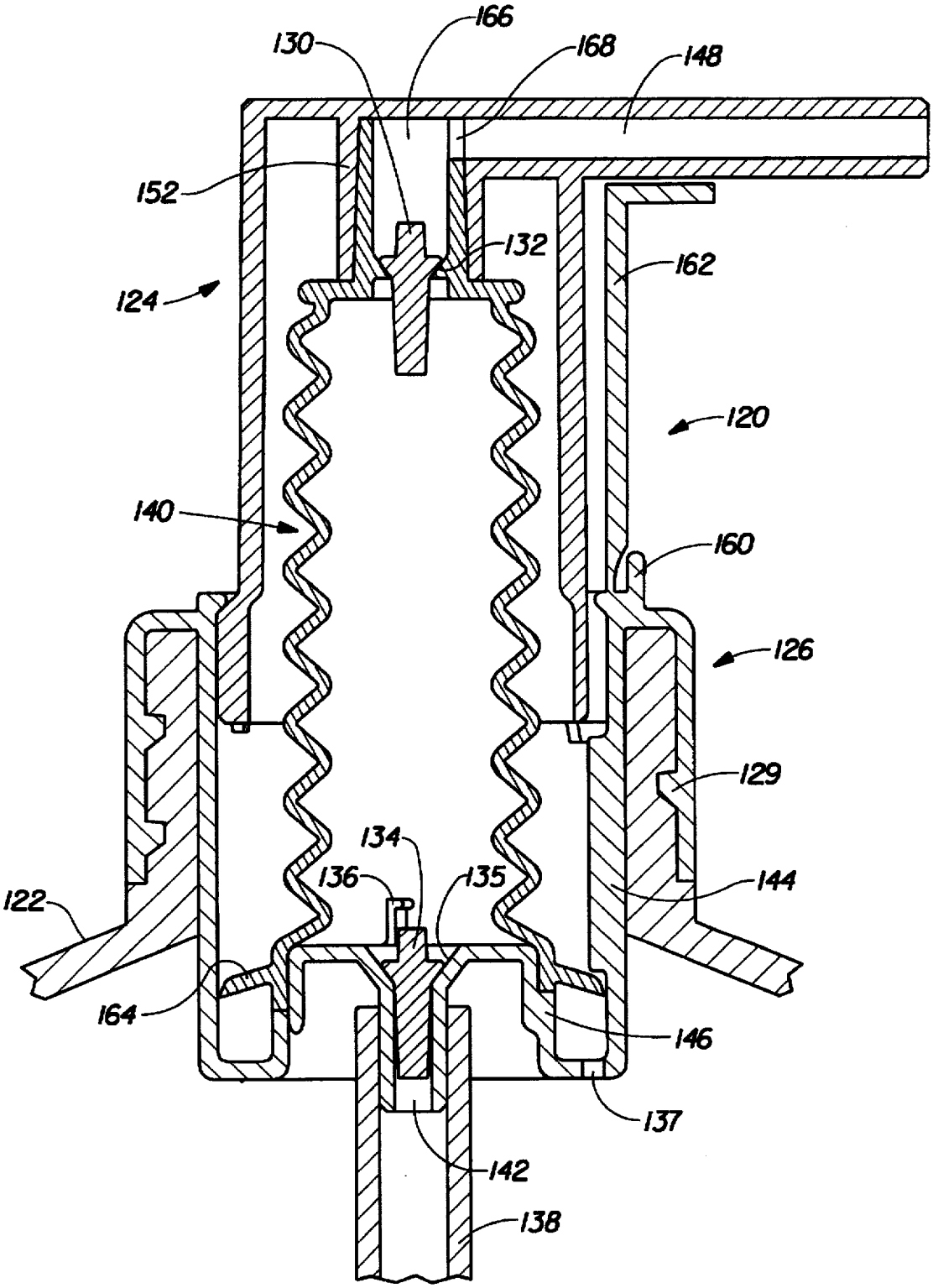
FIG. 7 is a cross-sectional view, similar to FIG. 3, of another preferred embodiment of the liquid dispensing pump of the present invention for pumping relatively large volumes.

Referring to FIG. 7, a large dose embodiment of a dispensing pump device of the present invention, indicated generally as 120, is provided. This pump device 120 is substantially identical to the previous pump device 20. The lower housing 126, however, extends into the container 122 to permit a bellows 140 of increased length. Of most significance, the tamper evident tab 162 is attached to the lower housing 126 instead of the upper housing 124. Although the tamper evident tab 162 does not prevent rotating the pump device 120 between open and closed shipping seal positions, it prevents actuation of the pump device 120 through interference with the nozzle surrounding the outlet passage 148 when in the open shipping seal position. Operation of this pump device 120 is substantially identical to that discussed above with respect to the previous pump device 20.

Figure 8:
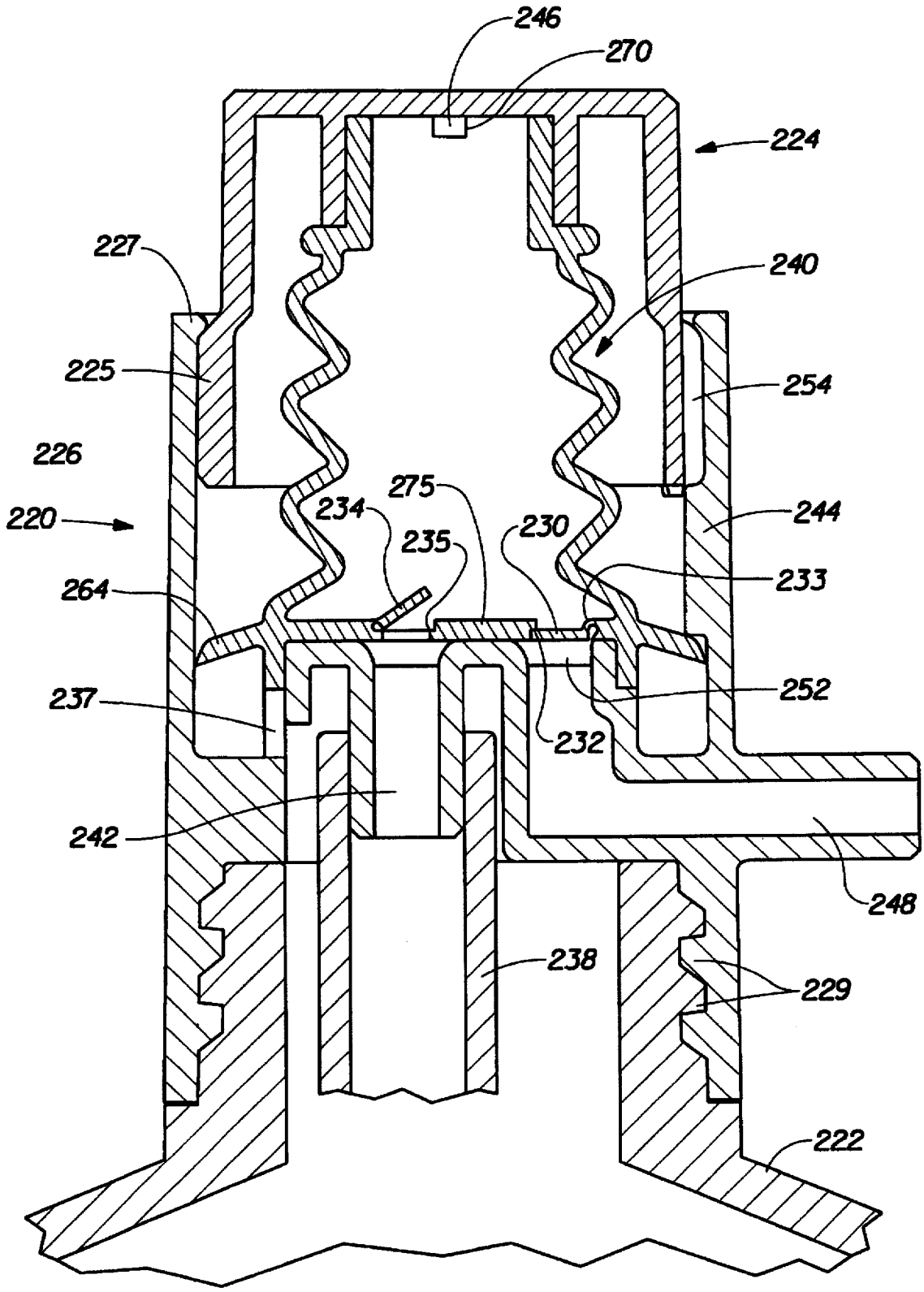
FIG. 8 is a cross-sectional view, similar to FIG. 3, of another preferred embodiment of the liquid dispensing pump of the present invention with a stationary nozzle with the shipping seal open.

Referring to FIG. 8, another embodiment of a liquid dispensing pump device of the present invention, indicated generally as 220, is illustrated in the open position. This pump device 220 provides a stationary nozzle. The housing 224 and 226 of this pump device 220 includes essentially the same tactile lugs 158, actuation lugs 244, and actuation channels 254 found in the previous embodiments. Thus, this pump device 220 has an open (seen in the drawings) and a closed shipping seal position (not seen) which is functionally similar to those discussed above. Both the inlet passage 242 and the outlet passage 248 of the housing 224 and 226, however, are located in the lower housing 226. Furthermore, the anti-rotation lugs 246 and their cooperating notches 270 are provided on the upper end of the upper housing 224 and on the bellows 240, respectively. Thus, the bellows 240 of this embodiment rotates with the upper housing 224 as the upper housing 224 is rotated relative to the lower housing 226 into the open position.

This bellows 240 includes the following functional elements integral therewith: the vent valve member 264, the inlet valve member 234, the inlet valve seat 235, the outlet valve member 230, the outlet valve seat 232, and a functional element of the shipping seal 268. The vent valve member 264 of this bellows 240 is essentially the same resilient annular flange integral with the previous bellows. Each of the inlet valve member 234 and outlet valve member 230 is a "U"-shaped flapper valve member. The valve members 234 and 230 are each molded at an angle (e.g., as seen or 90°) to the end wall 275 of the bellows inside the bellows 240 (i.e., in the direction the inlet valve member 234 is oriented in FIG. 8).

Once molded, the outlet valve member 230 is pushed through the opening so that it rests against the outlet valve seat 232. Thus the outlet valve member 230 is biased closed. The amount of biasing can be controlled somewhat by modifying the angle at which the outlet valve member 230 is molded, controlling the thickness of the hinge portion 233, and material selection. Consequently, if strong biasing is desired (e.g., in a trigger sprayer application) the angle would be relatively large, the hinge portion 233 can be relatively thick and the bellows 240 can be molded of a highly resilient material. The opposite would be true if a weak biasing force is desired (e.g., a lotion pump where significant suckback is desired).

The inlet valve member 234 is not pushed through its opening. Consequently, it is biased open to some extent. Again, the mount of biasing can be controlled. The inlet valve seat 232 is a thinned ledge integral with the bellows 240. Alternatively, the inlet valve seat 232 may be the adjacent horizontal wall of the lower housing 226.

Figure 9:
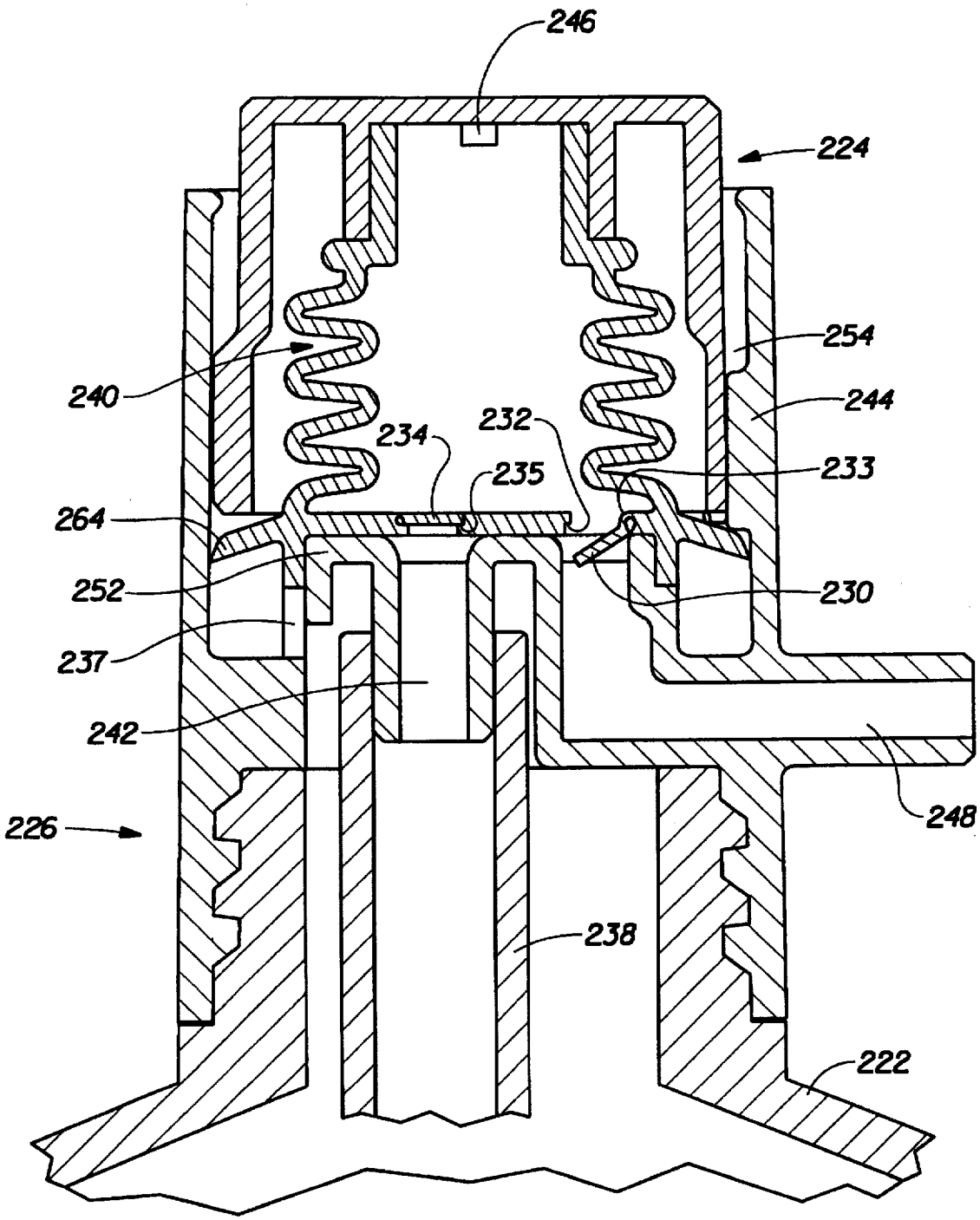
FIG. 9 is a cross sectional view, similar to FIG. 5, of the pump of FIG. 8 in operation, during the downstroke.
Figure 10:
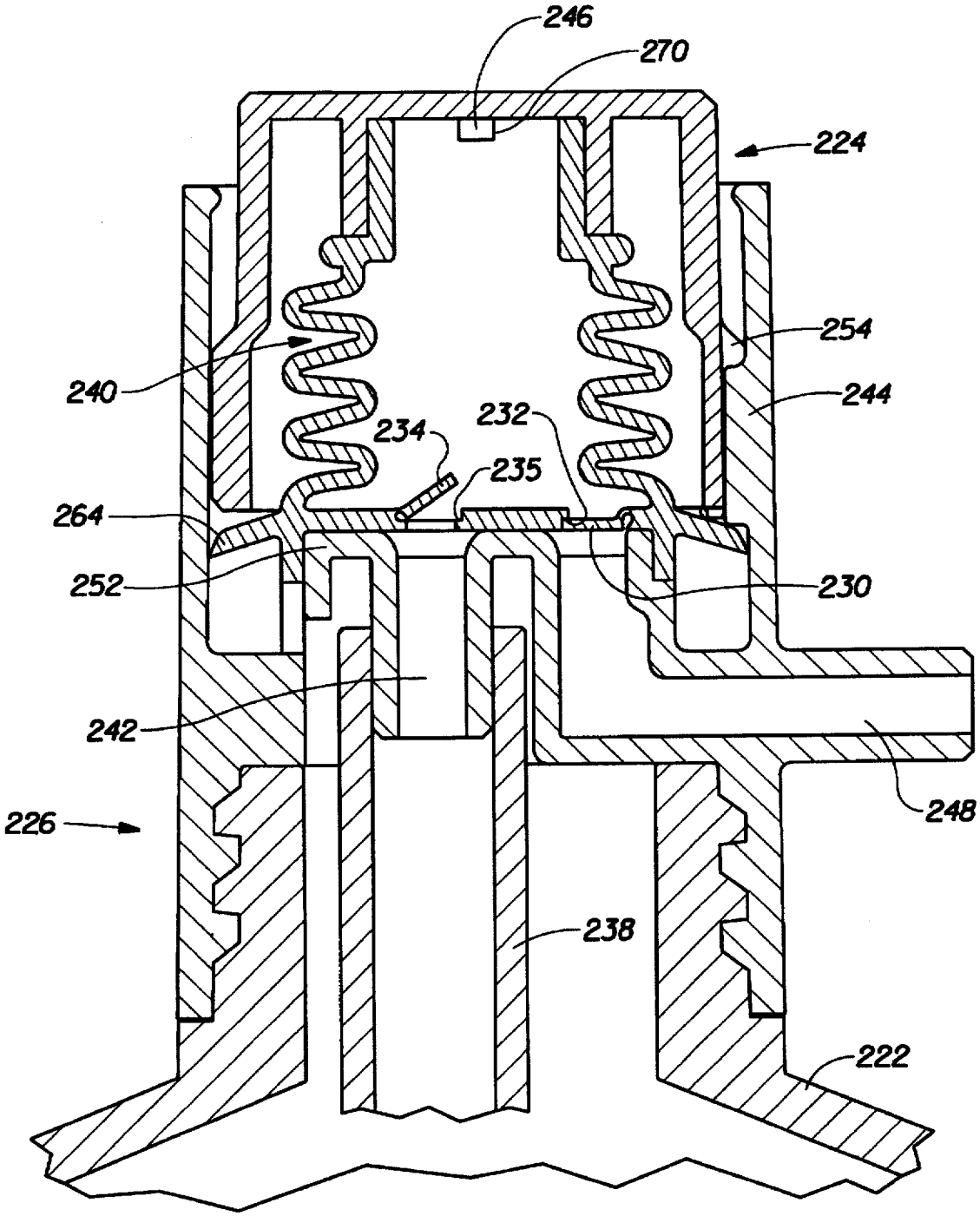
FIG. 10 is a cross sectional view, similar to FIG. 6, of the pump of FIG. 8 in operation, during the misstroke.

As seen in FIGS. 9 and 10, operation of this pump device 220 is quite similar to the previously described embodiments. Manual actuation of the pump device is accomplished by axially reciprocating the upper housing 224 relative to the lower housing 226. As this reciprocating action is accomplished the actuation lugs 244 slide within the actuation channels 254. During the downstroke of this reciprocating action, the inlet valve member 234 is sealed against the inlet valve seat 235. This causes pressure to increase within the pump chamber 240 which causes the outlet valve member 230 to move away from the outlet valve seat 232; thereby opening the outlet valve 230 and 232. Consequently, the liquid within the decreasing volume of the pump chamber 240 is dispensed through the integral outlet opening 68 and outlet passage 248.

Upon release of the manually compressive force, the bellows 240 begins to expand, due to its resiliency. This expansion creates a negative pressure within the pump chamber 240. Consequently, atmospheric pressure pushes liquid in the outlet passage 248 back into the bellows 240 until the outlet valve member 230 again seals against the outlet valve seat 232; thereby closing the outlet valve 230 and 232. Of course, the lower the biasing force on the outlet valve member 232, the more time it takes for the outlet valve member 232 to seat, and the more liquid is sucked back into the bellows 240.

Referring to FIG. 10, once the outlet valve 230 and 323 closes the negative pressure within the bellows 240 created as the bellows 240 continues to expand, causes the inlet valve member 234 to rotate away from the inlet valve seat 235; thereby opening the inlet valve 234 and 235. Thus, liquid from within the container 222 is pulled into the bellows 240 via the diptube 238 and past the inlet valve 234 and 235. Simultaneously, air is able to enter the container 222 to replace the volume of liquid exiting the container 222 by passing around the cup seal of the annular flange valve member 264 and the vent valve seat 224 and into the container 222 through the vent opening 237.

Figure 11:
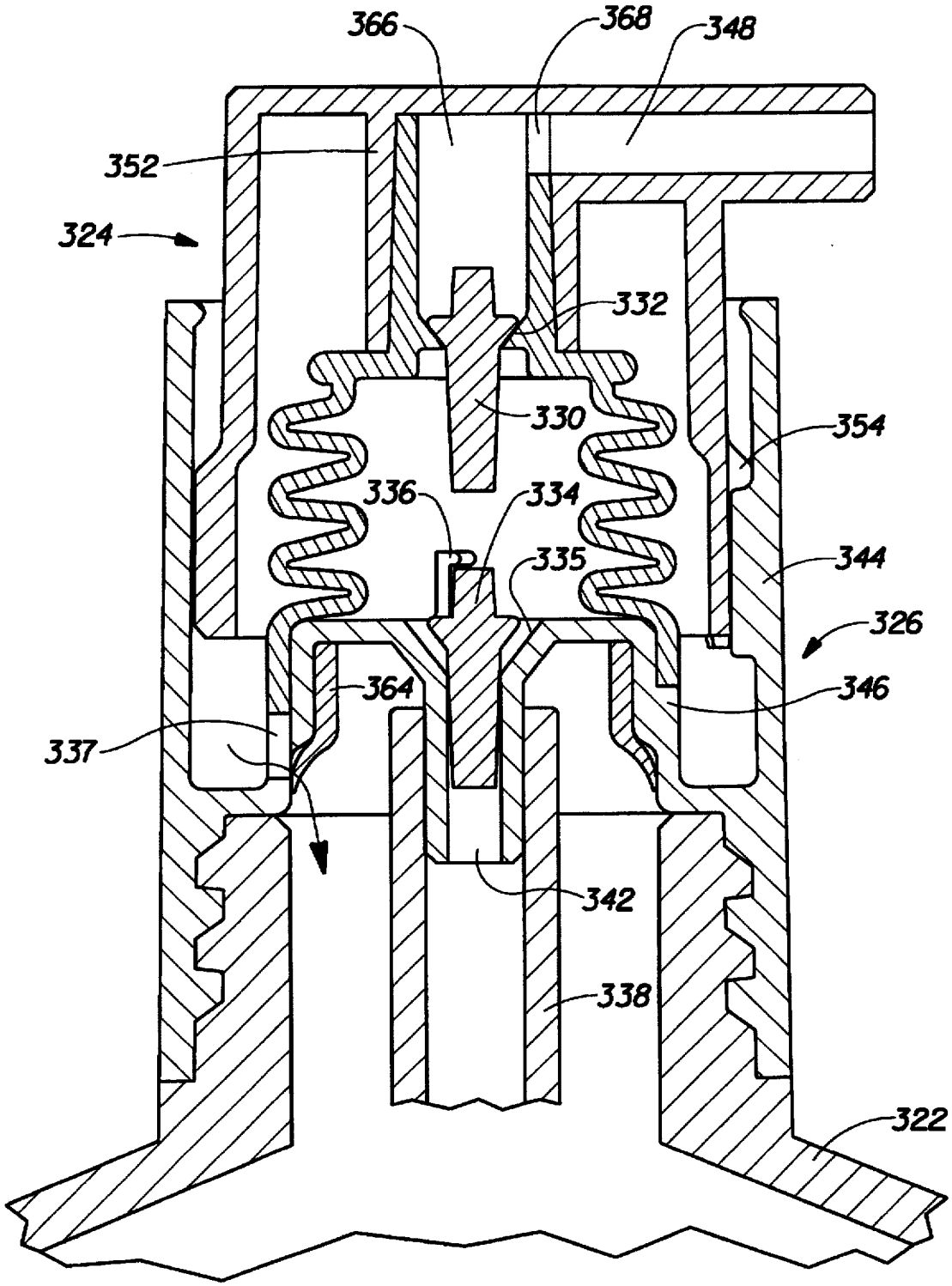
FIG. 11 is a cross sectional view, similar to FIG. 6, of an alternative venting arrangement.

FIGS. 11 through 14, illustrate alternative venting arrangements which may be utilized in lieu of the resilient annular flange integral with the previously described bellows. FIG. 11 utilizes a separate resilient annular flange 364 which is friction fit internally within the generally cylindrical wall of the lower housing 326. Thus, the flange 364 operates as a valve member which seals against the inner surface of the generally cylindrical wall operating as the valve seat. Air can enter the container 322 trough the vent opening 337 as indicated by the arrow.

Figure 12:
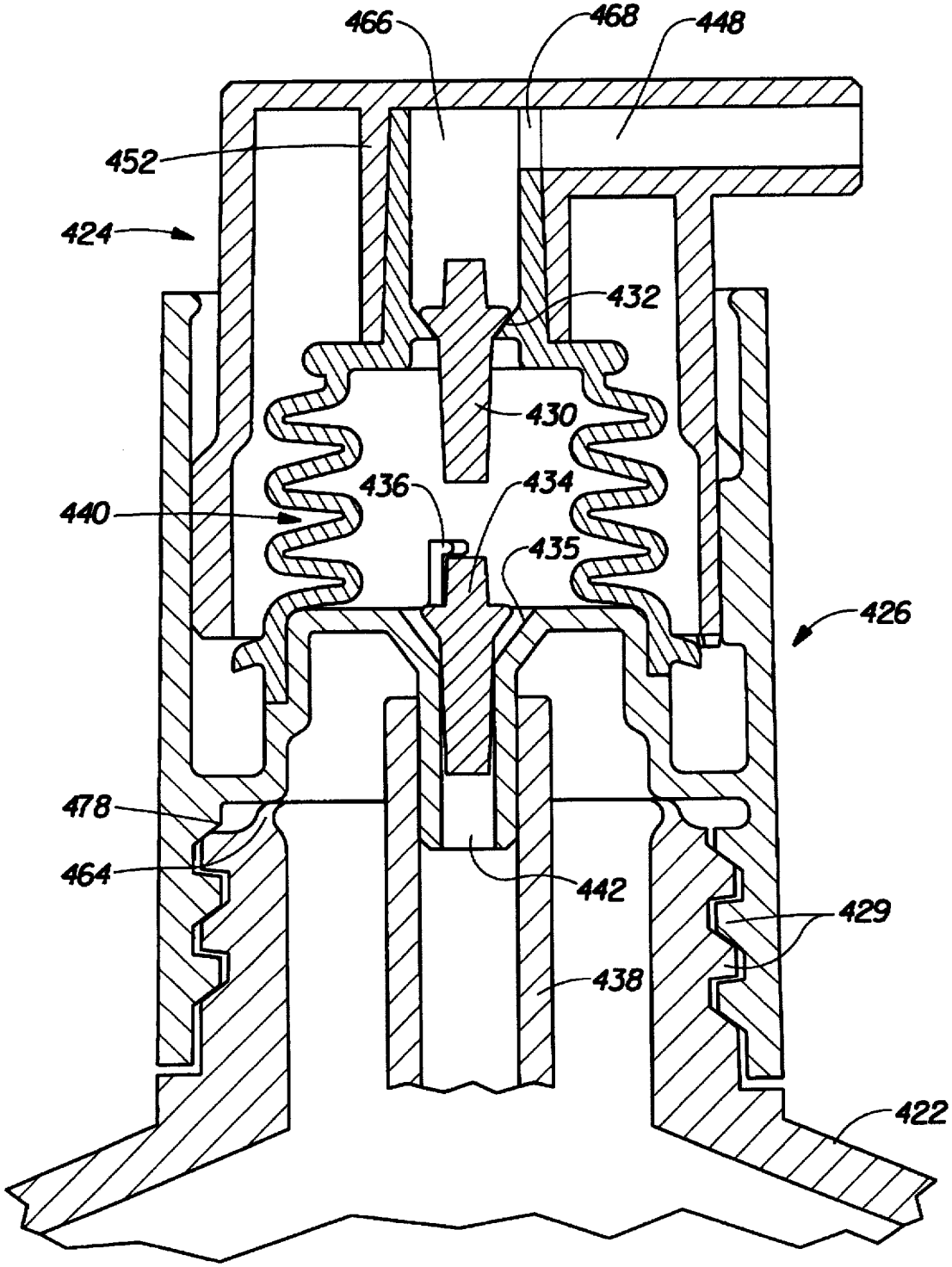
FIG. 12 is a cross sectional view, similar to FIG. 6, of another alternative venting arrangement.
Figure 13:
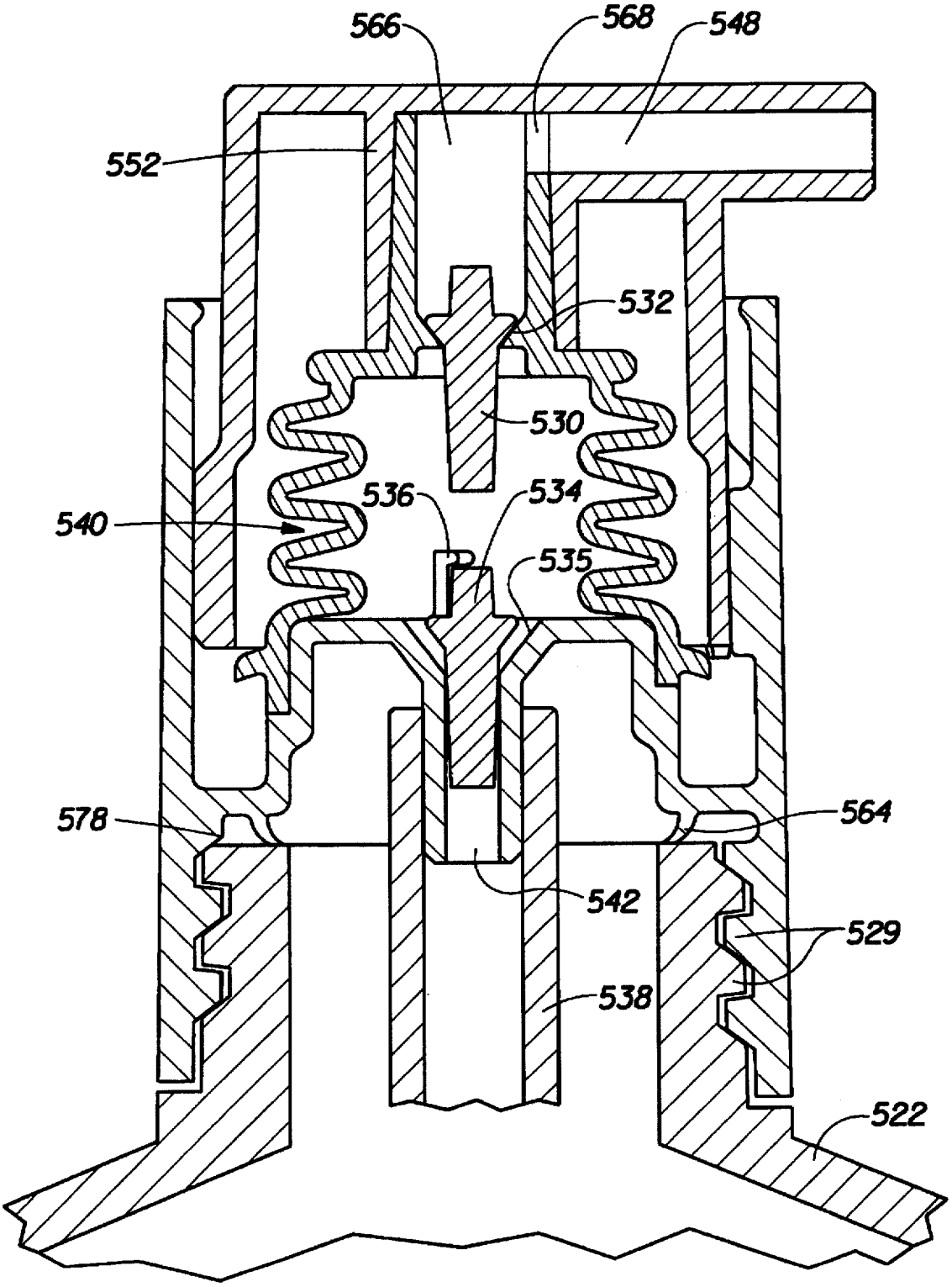
FIG. 13 is a cross sectional view, similar to FIG. 6, of another alternative venting arrangement.

FIGS. 12 and 13, utilize a conically shaped flexible member 464 and 564, respectively, which extends from the container 422 neck or lower housing 526, respectively. In each case a lug 478 and 578, respectively, is included to prevent overtightening of the lower housing 426 and 526 onto the container 422 and 522. In each case the generally conical flexible member 464 and 564 operates as the vent valve member which seals against a vent valve seat provided by the adjacent part; thereby forming a vent valve. Air is able to, enter the container 422 and 522 on the upstroke of the pump device 420 and 520 in response to differential pressure by passing around the threads 429 and 529 and between the vent valve member 464 and 564 and the vent valve seat 426 and 522.

Figure 14:
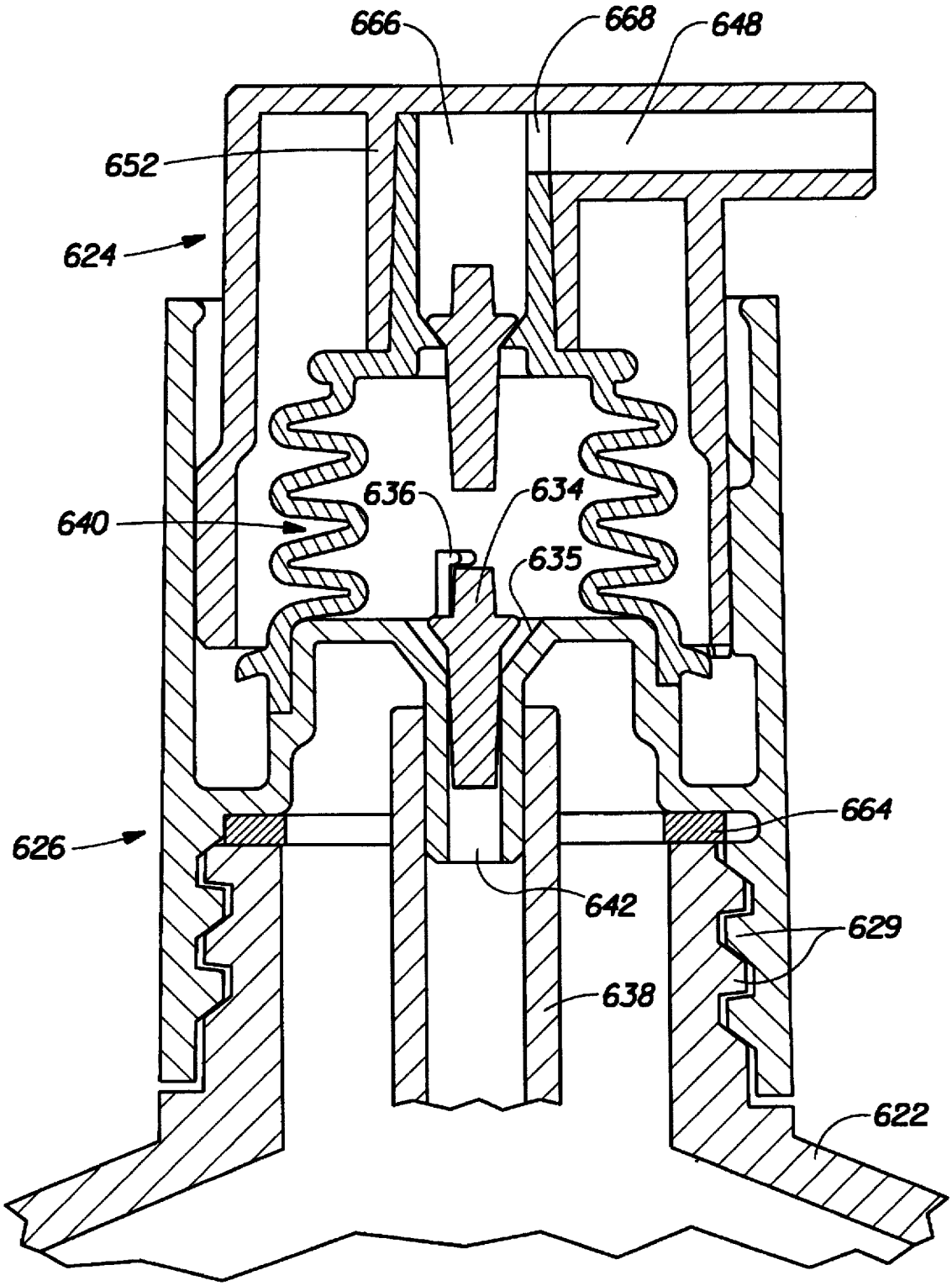
FIG. 14 is a cross sectional view, similar to FIG. 6, of another alternative venting arrangement.

FIG. 14 utilizes a gasket 664 as the vent valve. The gasket is porous such that air can pass through the gasket 664 but the liquid product cannot. Materials which can be utilized to make such gaskets 664 are commonly known in the art. For example, sintered polypropylene, and sintered polyethylene (such as porex) may be utilized. Thus air is able to enter the container 622 on the upstroke of the pump device 620 in response to differential pressure by passing around the threads 629 and through the gasket 664.

Figure 15:
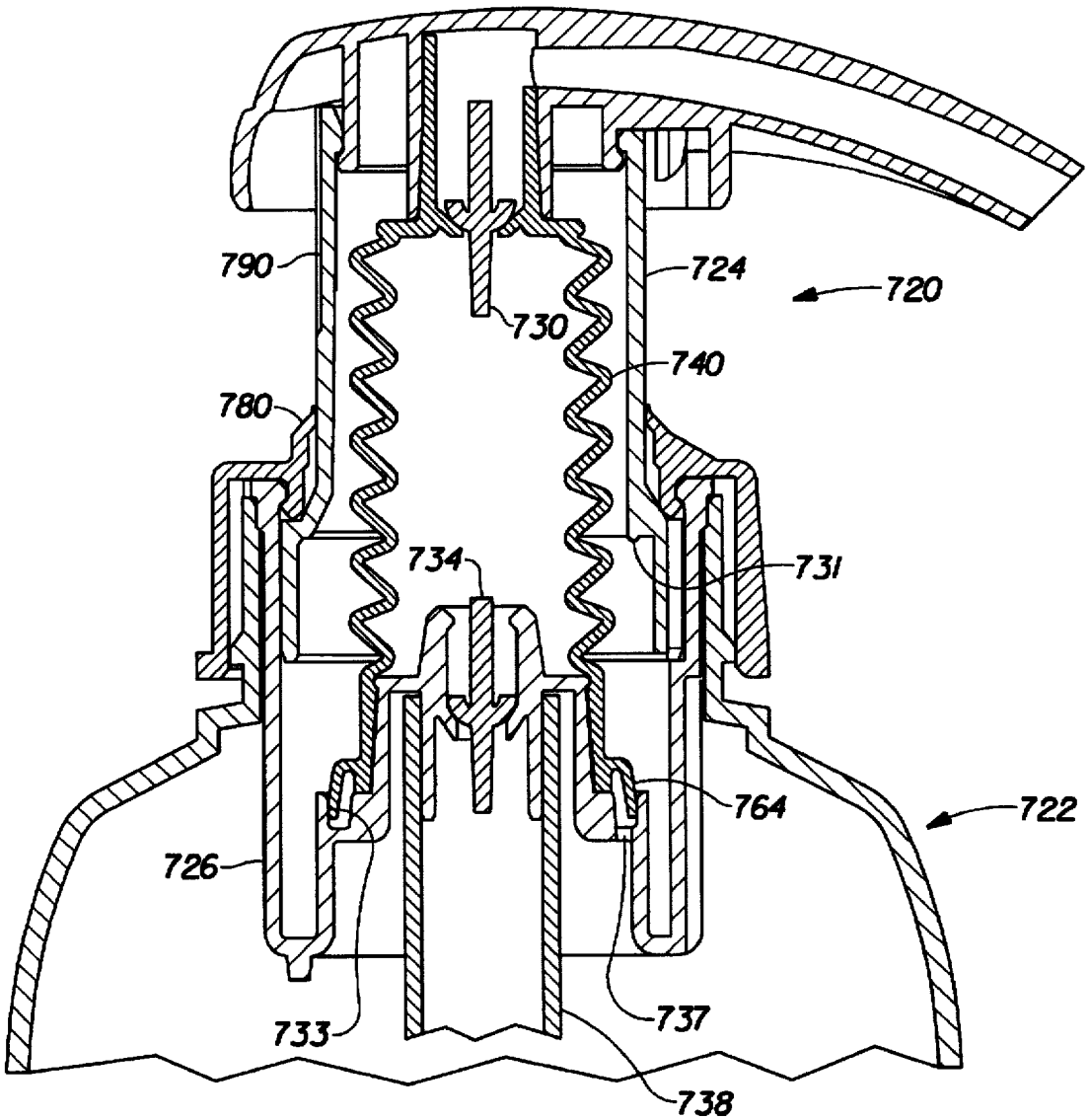
FIG. 15 is a cross sectional view similar to FIG. 3, of another preferred embodiment of the liquid dispensing pump of the present invention for pumping relatively large volumes, showing the pump prior to actuation.
Figure 16:
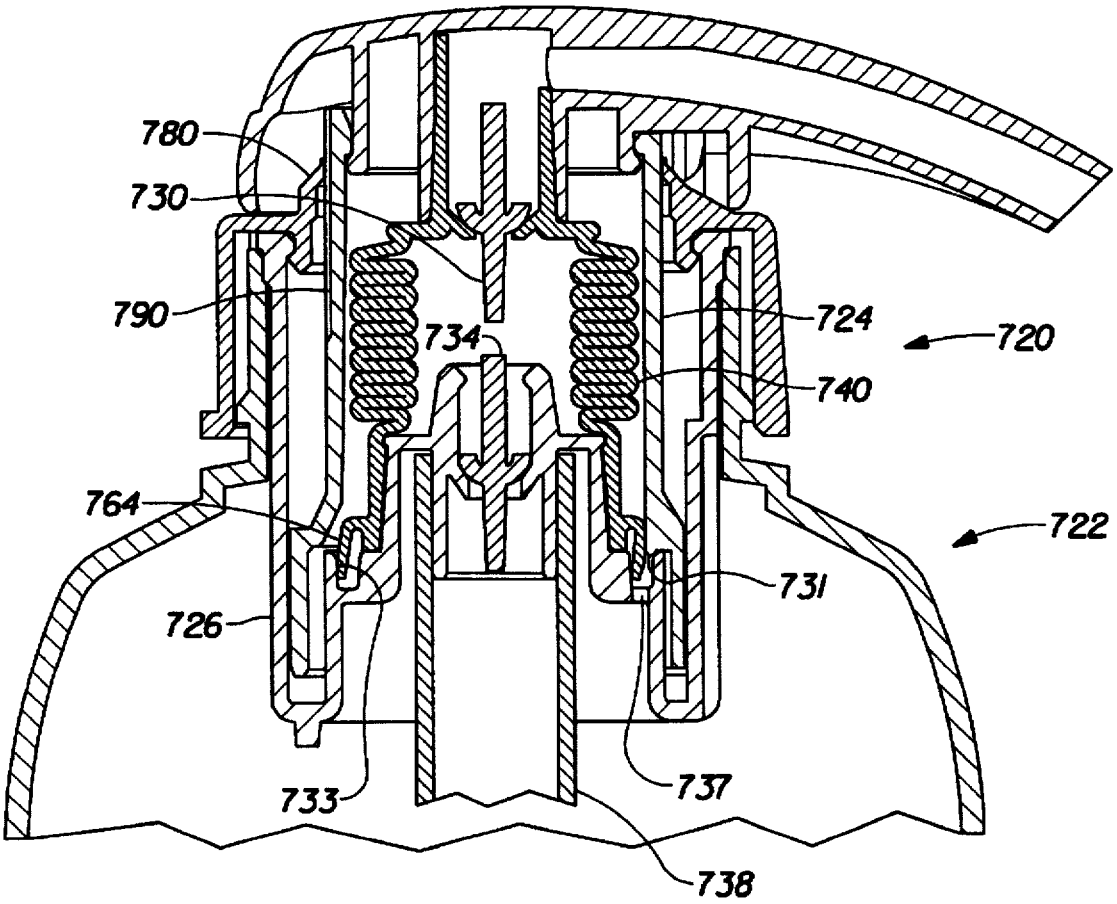
FIG. 16 is a cross sectional view thereof similar to FIG. 5, showing the pump after full actuation.

FIGS. 15 and 16 illustrate yet another embodiment. FIG. 15 shows a liquid dispensing pump device, generally indicated as 720. Pump device 720 is particularly useful in conjunction with a liquid supply container 722, seen partially in FIG. 15. The pump 720 includes an upper housing 724, a lower housing 726, an outlet valve member 730, an inlet valve member 734, a diptube 738, and a collapsible pump chamber 740, similar in construction to the embodiment of FIGS. 1, 2, and 3. Pump device 720 is preferably connected to supply container 722 in a sealed manner, such as by screw threads on supply container 722 engaging mating screw threads on lower housing 726.

Upper housing 724 is telescoped into lower housing 726. Lower housing 726 has an interior surface 733 and vent opening 737, which is in fluid communication with the inside of supply container 722. Upper housing 724 slides along an upright axis in lower housing 726 when upper housing 724 is depressed, thereby actuating pump device 720. Extending downward from inside upper housing 724 is at least one lug or protrusion 731, whose function is described hereinafter.

Collapsible pump chamber 740 is shown as a bellows. Bellows 740 is made of a resilient material and is designed to be resilient axially, as described for other embodiments. Bellows 740 includes an integral annular flange 764 near its inlet end. Flange 764 is sized to press against interior surface 733 of lower housing 726. Along with vent opening 737, flange 764 and interior surface 733 form a vent valve for supply container 722, which is otherwise sealed from ambient air to pump device 720.

Upon actuation of pump 720, liquid from within supply container 722 is pulled into bellows 740 via diptube 738 and past inlet valve member 734. A vacuum is created in supply container 722 by the reduction in volume of liquid which was pumped from container 722. In order to prevent container 722 gradually collapsing as further actuation of pump 720 occurs, air must be vented into container 722 by deflecting flange 764, which is normally sealed against interior surface 733. When flange 764 is deflected away from interior surface 733, ambient air may pass around flange 764 and through vent opening 737 into container 722. The sealing of flange 764 against interior surface 733 may be overcome by two different means. First, vacuum generated in supply container 722 after successive partial actuations of upper housing 724 may deflect flange 764 downward to break the seal. Preferably, the resilience of flange 764 is such that a vacuum in supply container 722 of at least two inches of water to 10 inches of water is necessary to break the seal. Such a threshhold vacuum is intended to minimize the entrance of moisture into the supply container when the pump is used in a wet environment.

Second flange 764 may be deflected by one or more lugs 731 extending downward from upper housing 724. Preferably, each lug contacts flange 764 near or at the end of the downward actuation of upper housing 724 into lower housing 726. More preferably, contact occurs when the upper housing is within 10% of the end of it's full downward actuation stroke. Even more preferably, lug 731 deflects flange 764 away from interior surface. 733 by 0.025 mm or less, again to minimize the entrance of moisture into the supply container when the pump is used in a wet environment.

Having two modes of venting ambient air to supply container 722 is beneficial because the vent valve could possibly become stuck due to contamination, in which case the mechanical deformation of the vent valve by an actuator lug serves to forcefully unstick the flange from the interior surface. The mechanical deformation occurs only near or at the end of the pump stroke when the upper housing is fully actuated. Lug 731 preferably has dimensions of 0.25 mm long by 0.63 mm diameter.

Alternatively the pump may be stroked partially, without ever making contact between an upper housing lug and the flange. In this situation, it is beneficial to have the flange deflect and vent air when a threshhold vacuum level is reached. A threshhold vacuum may be established by adjusting the thickness, length, and stiffness of the resilient flange material. In a preferred embodiment, flange 764 has an outer diameter of 21.6 mm, an average thickness of 0.34 mm, a cantilevered length of 3.41 mm, and it is made of Ethylene Vinyl Acetate. Flange 764 is preferably angled downward at an angle of 12 degrees from the upright pump axis. Interior surface 733 may be the sliding surface of lower housing 726 or it may be a surface on an annular rib or wall internal to the sliding surface of lower housing 726. Preferably the diameter of interior surface 733 is 21.27 mm. It has a smooth finish and the lower housing 726 is preferably made of Polypropylene.

To further protect supply container 722 from moisture contamination during use in a wet environment, FIGS. 15 and 16 show an annular wiper 780 extending upward from lower housing 726, and in friction contact with telescopingly engaged upper housing 724. When upper housing 724 is actuated downward into lower housing 726, wiper 780 wipes any condensation or other moisture from the upper housing. The relatively sharp tip of the wiper causes the moisture to flow over the outside of the wiper when the upper housing moves through it. With friction contact between the wiper and upper housing venting of air trapped inside the upper and lower housings becomes important as the former telescopes into the latter. Upper housing 724 has an axial groove 790 located along its outer surface to vent this trapped air. Limiting fluid communication to the groove helps to minimize any moisture entry past the wiper and into the lower housing.

Groove 790 preferably has a width of 1.17 mm and a depth of 0.13 mm. It has a length such that when the upper housing is fully retracted, the groove does not extend past the annular wiper. That is, when the pump is inactive, the wiper provides maximum sealing against moisture entering the space between upper and lower housings. In order to achieve adequate flow rate of air through the groove without making the groove too deep for appearance reasons, multiple shallow grooves may be used.

Wiper 780 is either a separate part connected to lower housing 726 or it is molded integrally with lower housing 726. Wiper 780 preferably has an internal diameter of 23.32 (+0.05) mm, while the portion of upper housing telescoping through the wiper preferably has an outer diameter of 23.32 (−0.05) mm.

Although particular embodiment of the present invention have been illustrated and described, modifications may be made without departing from the teaching of the present invention. For example, liquid dispensing pump devices may be in the form of a trigger sprayer or a foamer. Accordingly, the present invention comprises all embodiments within the scope of the impended claims.

What we claim is:

1. A manually operated dispensing pump device for pumping a liquid from a supply container and discharging the liquid through a discharge orifice comprising:

(a) a housing for sealingly mounting the dispensing pump device onto the supply container, the housing including a portion of a liquid passage providing fluid communication from the supply container downstream to the discharge orifice;

(b) an inlet valve located within the liquid passage, the inlet valve being opened to permit liquid flow therethrough during periods of negative downstream pressure;

(c) an outlet valve located within the liquid passage, the outlet valve being open to permit liquid flow therethrough during periods of positive upstream pressure and being closed during periods of negative upstream pressure;

(d) a shipping seal including two functional elements which cooperate when in a open position to permit liquid flow through the liquid passage; and (e) a collapsible pump chamber defining a portion of the liquid passage downstream of the inlet valve and upstream of the outlet valve, the collapsible pump chamber including one of the functional elements of the shipping seal as an integral component thereof such that the collapsible pump chamber and said one of the functional elements of the shipping seal is a single unitary part.

2. A manually operated dispensing pump device according to claim 1 further including a locking feature operatively associated with the housing which prevents actuation of the pump device when the shipping seal is in the closed position and which permits actuation of the pump device when the shipping seal is in the open position.

3. A manually operated dispensing pump device according to claim 1 further comprising a removable tamper evident tab operatively associated with the upper housing or the lower housing which prevents actuation of the pump device prior to removal of the tamper evident tab.

4. A manually operated dispensing pump device for pumping a liquid from a supply container and discharging the liquid through a discharge orifice comprising:

(a) a housing for sealingly mounting the dispensing pump device onto the supply container, the housing including a portion of a liquid passage providing fluid communication from the supply container downstream to the discharge orifice;

(b) an inlet valve located within the liquid passage, the inlet valve being opened to permit liquid flow therethrough during periods of negative downstream pressure;

(c) an outlet valve located within the liquid passage, the outlet valve being open to permit liquid flow therethrough during periods of positive upstream pressure and being closed during periods of negative upstream pressure;

(d) a shipping seal including two functional elements which cooperate when in a opened position to permit liquid flow through the liquid passage and cooperate once the upper housing and the lower housing are rotated relative to each other to an open position to permit liquid flow through the liquid passage; and (e) a collapsible pump chamber defining a portion of the liquid passage downstream of the inlet valve and upstream of the outlet valve, the collapsible pump chamber including one of the functional elements of the shipping seal as an integral component thereof such that the collapsible pump chamber and said one of the functional elements of the shipping seal is a single unitary part.

5. A manually operated dispensing pump device according to claim 4 wherein the collapsible pump chamber further includes an anti-rotation element to prevent rotation of the collapsible pump chamber relative to the upper housing or the lower housing as the upper and the lower housings are rotated relative to each other between open and closed positions.

6. A manually operated dispensing pump device according to claim 4 further including a locking feature operatively associated with the housing which prevents actuation of the pump device when the shipping seal is in the closed position and which permits actuation of the pump device when the shipping seal is in the open position.

7. A manually operated dispensing pump device according to claim 6 further comprising a removable tamper evident tab operatively associated with the upper housing or the lower housing which prevents actuation of the pump device prior to removal of the tamper evident tab.

8. A manually operated dispensing pump device according to claim 7 wherein the housing further includes a locking projection which cooperates with the tamper evident tab to prevent rotation of the upper housing from the closed position to the open position without removal of the tamper evident tab from the housing.

9. A manually operate dispensing pump device according to claim 4 wherein a functional element of the outlet valve is an integral component of the collapsible pump chamber.

10. A manually operated dispensing pump device according to claim 9 wherein the functional elements of the outlet valve are the outlet valve seat and outlet valve member and the outlet valve seat is the integral functional element and the outlet valve member is located within an elongate channel which is an integral component of the collapsible pump chamber.

11. A manually operated dispensing pump device according to claim 9 further comprising a vent valve including two functional element, and wherein one of the functional elements of the vent valve is and integral component of the collapsible pump chamber.

12. A supply container venting system for a dispensing pump, said venting system operated by two different means and comprising:

a) a dispensing pump having a lower housing for sealingly mounting said dispensing pump onto a supply container, said lower housing having an interior surface; said lower housing also having a vent opening therethrough internal to said interior surface and in fluid communication with said supply container;

b) an upper housing telescopingly engaged with said lower housing and acting as a pump actuator, said upper housing having at least one lug;

c) a pump chamber having a resilient annular flange angled downward therefrom, said annular flange sized to press against said interior surface of said lower housing to seal said vent opening from communication with ambient air and moisture, said annular flange remaining in contact with said interior surface until either a vacuum generated in said supply container by pumping fluid therefrom deflects said flange away from said interior surface or said at least one lug contacts and deflects said annular flange when said upper housing is actuated downward.

13. The supply container venting system for a dispensing pump of claim 12 wherein said pump chamber comprises a resiliently collapsible pump chamber.

14. The supply container venting system for a dispensing pump of claim 12 wherein said pump chamber comprises a bellows which has said annular flange molded integral therewith.

15. The supply container venting system for a dispensing pump of claim 12 further comprising an upwardly angled annular wiper connected to said lower housing, said wiper being in sliding contact with said telescopingly engaged upper housing to minimize moisture entering said lower housing when said dispensing pump is actuated in a wet environment.

16. The supply container venting system for a dispensing pump of claim 15 further comprising an axial groove in said upper housing, said groove providing fluid communication across said annular wiper in order to vent air to and from said lower housing when said upper housing is actuated.

17. The supply container venting system for a dispensing pump of claim 12 wherein said annular flange has a resilience such that sealing is maintained between said flange and said interior surface until a vacuum in said supply container reaches a level ranging from two to ten inches of water.

18. The supply container venting system for a dispensing pump of claim 12 wherein said integral lug deflects said annular flange away from said interior surface by less than 0.025 mm to enable venting to occur while minimizing opportunity for moisture to enter said supply container.

19. The supply container venting system of claim 12 wherein at least one lug contacts said annular flange when said upper housing is within 10% of being fully actuated downward.

* * * * *